US007350840B2

(12) United States Patent
Franzen et al.

(10) Patent No.: US 7,350,840 B2
(45) Date of Patent: Apr. 1, 2008

(54) LIFTING DEVICE FOR CONTAINERS

(75) Inventors: Hermann Franzen, Mönchengladbach (DE); Joachim Kröll, Jüchen (DE)

(73) Assignee: Gottwald Port Technology GmbH, Duesseldorf (DE)

( * ) Notice: Subject to any disclaimer, the term of this patent is extended or adjusted under 35 U.S.C. 154(b) by 0 days.

(21) Appl. No.: 10/526,795

(22) PCT Filed: Aug. 28, 2003

(86) PCT No.: PCT/EP03/09522

§ 371 (c)(1),
(2), (4) Date: Sep. 19, 2005

(87) PCT Pub. No.: WO2004/033357

PCT Pub. Date: Apr. 22, 2004

(65) Prior Publication Data

US 2006/0125258 A1 Jun. 15, 2006

(30) Foreign Application Priority Data

Sep. 13, 2002 (DE) ..... 102 43 844

(51) Int. Cl.
*B66C 1/10* (2006.01)

(52) U.S. Cl. ..... 294/81.4

(58) Field of Classification Search ..... 294/81.4, 294/81.5, 81.3; 212/73, 204, 342
See application file for complete search history.

(56) References Cited

U.S. PATENT DOCUMENTS

| | | | | |
|---|---|---|---|---|
| 1,270,995 | A * | 7/1918 | Weickel | 294/81.4 |
| 4,482,285 | A * | 11/1984 | Copie | 294/81.4 |
| 5,338,150 | A * | 8/1994 | Focke et al. | 294/67.31 |
| 6,431,379 | B1 * | 8/2002 | Kroll et al. | 294/81.2 |

FOREIGN PATENT DOCUMENTS

| | | |
|---|---|---|
| DE | 3416284 A | 11/1985 |
| EP | 0763497 A1 | 3/1997 |
| GB | 0975154 | 11/1964 |
| JP | 84598 | 7/1981 |
| JP | 2000-159476 | 6/2000 |
| JP | 2000-291609 | 10/2000 |
| JP | 2002-137895 | 5/2002 |

* cited by examiner

*Primary Examiner*—Saul Rodriguez
*Assistant Examiner*—Paul T Chin
(74) *Attorney, Agent, or Firm*—Van Dyke, Gardner, Linn & Burkhart, LLP

(57) ABSTRACT

A lifting device for containers comprises at least one hydraulic cylinder arranged on a support frame with a piston and piston rod and at least two, spaced-apart horizontal guiding cross-bars. Lengthwise displacement of the piston rod is transformed into a synchronous upward and downward movement by at least one angle lever pivoted on the support frame. The at least one angle lever comprises two lever arms, one of the lever arms being connected to the piston rod and the other of the lever arms being connected to one of the guiding cross-bars. The guiding cross-bars are connected to a load receiving device for the container and are guided on vertical support pillars of the support frame at both ends for lifting and lowering the container.

15 Claims, 6 Drawing Sheets

LIFTING DEVICE FOR CONTAINERS

BACKGROUND OF THE INVENTION

The invention concerns a lifting device for containers, especially ISO containers which can be handled by means of container handling gear, with a drive means for traction means, which is arranged on a supporting frame in order to raise and lower the container by means of a load-receiving means arranged on the lower end of the traction means.

At container ports and in container yards, ISO containers are loaded and unloaded by means of handling gear, especially by means of straddle loaders, straddle carriers and container movers, which are used for the loading and unloading of trucks, railroad cars, trailers, or even automated guided vehicles (AGV). The trucks, railroad cars, trailers and automated guided vehicles are passive transportation vehicles, since they cannot themselves pick up and put down the containers being transported, whereas straddle loads, straddle carriers and container movers are active transportation vehicles, i.e., a container being transported within the container yard or the container port can also be picked up and placed down by them.

It is known that container handling equipment have motors on their chassis, which drive one or more cable winches. The cables of the winches are guided across several deflection rollers to four fastening points of a load-receiving means in the form of a spreader. By means of the motor or motors, the cables are wound and unwound, thereby varying the lift height of the spreader. The loading or unloading of a passive transportation vehicle begins when an ISO container is picked up by means of the spreader and lifted by winding up the cables. The container handling unit now travels the container above the transport vehicle and sets the container down on its loading surface. The unloading of the transportation vehicle occurs accordingly in the opposite sequence. The container handling equipment is likewise used for transport of containers within the container yard and container port, the container being lifted during the transport.

The cable lifting mechanisms used in the container handling equipment require an intensive maintenance, which leads to long down times for the container handling equipment, besides high maintenance costs. At the same time, the known cable lifting mechanisms are bulky in construction.

The container handling equipment is used for the loading of trucks, railroad cars, trailers, or also automated guided vehicles, on which the containers are not stacked one on the other. Consequently, only low heights of 1.2 m to 3.8 m can be achieved, so that the cable lifting mechanisms can also be smaller in dimension.

SUMMARY OF THE INVENTION

The purpose of the invention is therefore to create a low-volume lifting device for container handling equipment for a relatively small bridging height.

This purpose is accomplished by a lifting device with the features of claim 1. Advantageous configurations of the lifting device are indicated in the subsidiary claims.

The solution entails that the drive means comprises at least one hydraulic cylinder with a piston and a piston rod, whose lengthwise displacement is transformed into a synchronous upward and downward movement of at least two distanced horizontal guiding cross-bars, which are connected respectively to the upper ends of the traction means, the guiding cross-bars being guided at both ends on vertical beams of the supporting frame. The more economical hydraulic cylinder represents a maintenance-friendly drive system for the lifting device, at the same time ensuring a high carrying capacity with a small footprint. The guiding of the two ends of the guiding cross-bars further reduces the twisting of the suspended load-receiving means relative to the support frame and/or the container. This ensures a torsion-proof and exact orienting of the load-receiving means in relation to the container being picked up.

A flat-design lifting device on top of the spreader is achieved by transforming the transmission of force of the hydraulic cylinder and the lengthwise motion of the piston rod above the container into the upward and downward movement, which is accomplished by means of angle levers, with two lever arms each, pivoted on the support frame, one lever arm of one angle lever being connected to a piston rod and the other lever arm of said angle lever being connected to a guiding cross-bar.

If the lever arm of an angle lever connected to the piston rod is linked by means of a rod-shaped coupling element to a lever arm of another angle lever, whose other lever arm is connected to the other guiding cross-bar, the corresponding traction means move synchronously to each other in the vertical direction. At the same time, the use of the angle levers enables a flat-design lifting device.

A mechanically stable connection is achieved when the guiding cross-bars are each connected by means of a coupling rod to one lever arm.

A tilting of the guiding cross-bars is prevented if the guiding cross-bars are each connected by means of a connecting rod to a lever arm on both sides of the middle of the cross-bars.

The transformation of the lengthwise displacement into the lifting and lowering movement by means of lifting cables which are deflected and fastened to a single piston rod, being connected at the other end at least indirectly to the guiding cross-bars, wherein the deflection is done by means of freely turning deflection rollers, enables the use of a maintenance-friendly and more economical hydraulic cylinder in a flat-design construction. An additional synchronization of the lifting cables fastened to a single piston rod is not required.

Preferably the deflection of the lifting cables occurs in the direction vertical to the particular guiding cross-bars by means of a freely turning deflection roller.

The invention will now be described by means of a drawing.

DETAILED DESCRIPTION OF THE PREFERRED EMBODIMENT

Figure 1:
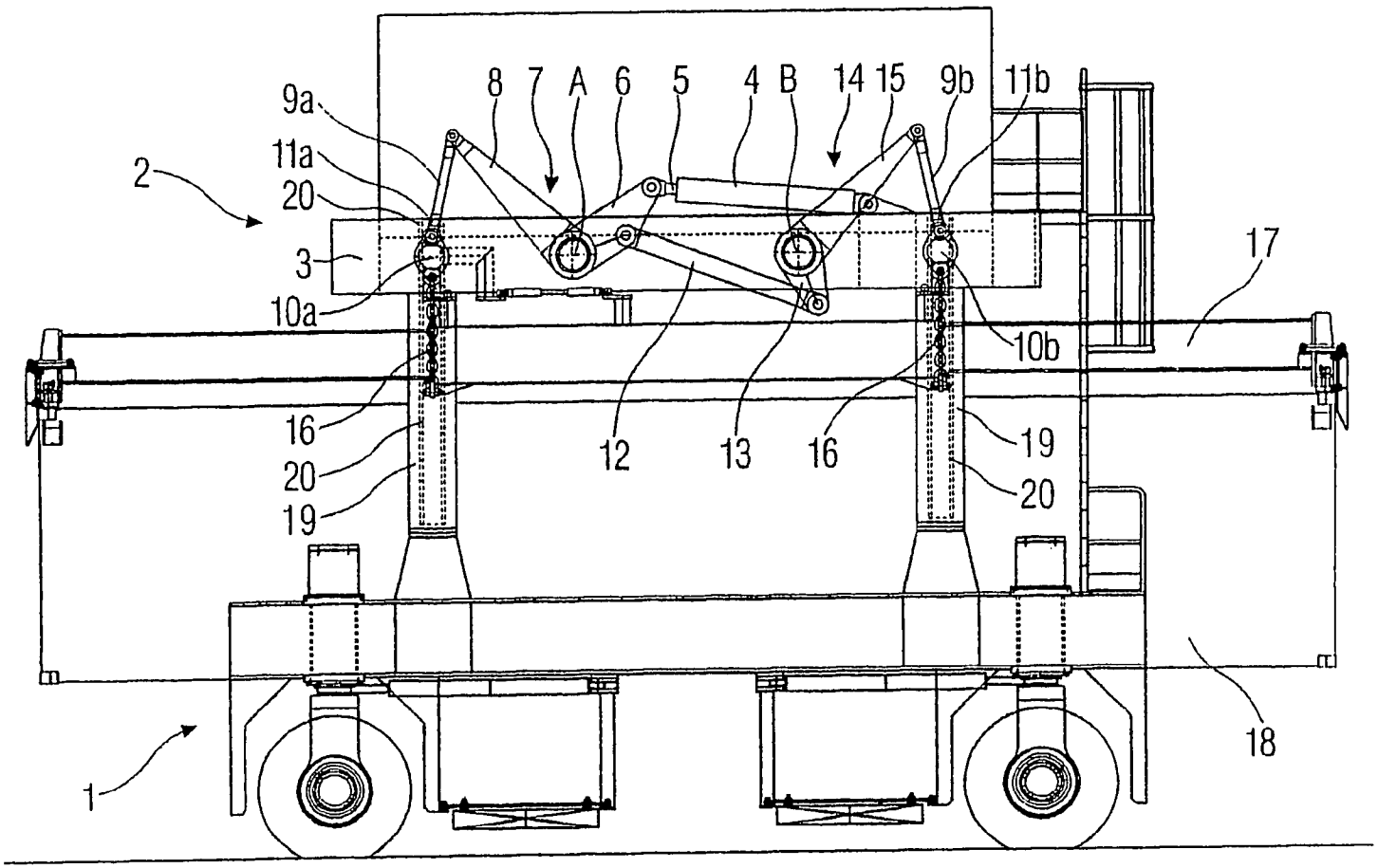
FIG. 1 is a side elevation of a container handling unit with a lifting device using angle levers.

FIG. 1 shows a container handling unit 1 with a lifting device 2, having a support frame 3. Linked to the support frame 3 is a hydraulic cylinder 4, whose piston rod 5 is connected to a lever arm 6 of an angle lever 7, which is pivoted about its axis A, located at the apex. The other lever arm 8 is connected via a vertical coupling rod 9*a* to a guiding cross-bar 10*a* by means of a tie bracket 11*a*. To the lever arm 6 of the angle lever 7 is linked a horizontal coupling rod 12, which is connected at its other end to a lever arm 13 of a second angle lever 14, which is likewise pivoted about its axis B located at the apex. The lever arm 15 of this angle lever 14 is likewise connected via a vertical coupling rod 9*b* to a guiding cross-bar 10*b* by means of a tie bracket 11*b*. The two vertical coupling rods 9*a*, 9*b* each engage the upper ends of the respective tie brackets 11*a*, 11*b*, while at the lower ends of the tie brackets 11*a*, 11*b* are arranged additional traction means 16 in the form of chains. Secured to the lower ends of the chains is the spreader 17, being the load-receiving means. The horizontal position of the spreader 17 is parallel with the standing surface of the container handling unit 1.

The container 18 is situated at low height above the standing surface. The piston rod 5 of the hydraulic cylinder 4 is retracted, so that the guiding cross-bars 10*a*, 10*b* and consequently the spreader 17 are in their upper end position. This upper end position is likewise the transport position for the spreader 17, the lifting device 2, and the container 18. The angle levers 7, 14—as FIG. 1 shows—project only slightly above the support frame 3 in the transport position.

Figure 2:
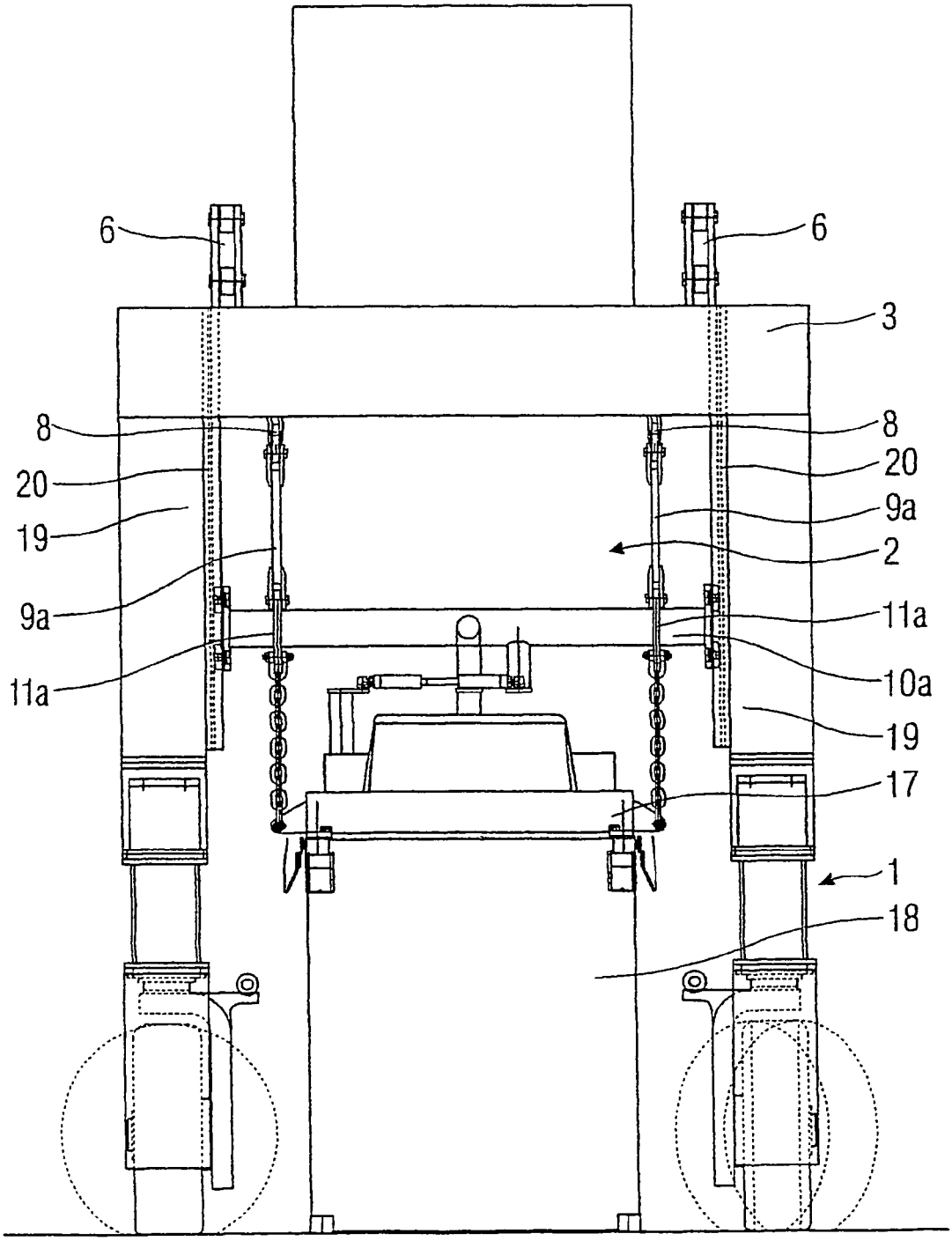
FIG. 2 is a front view of a container handling unit of the lifting device in FIG. 1.
Figure 4:
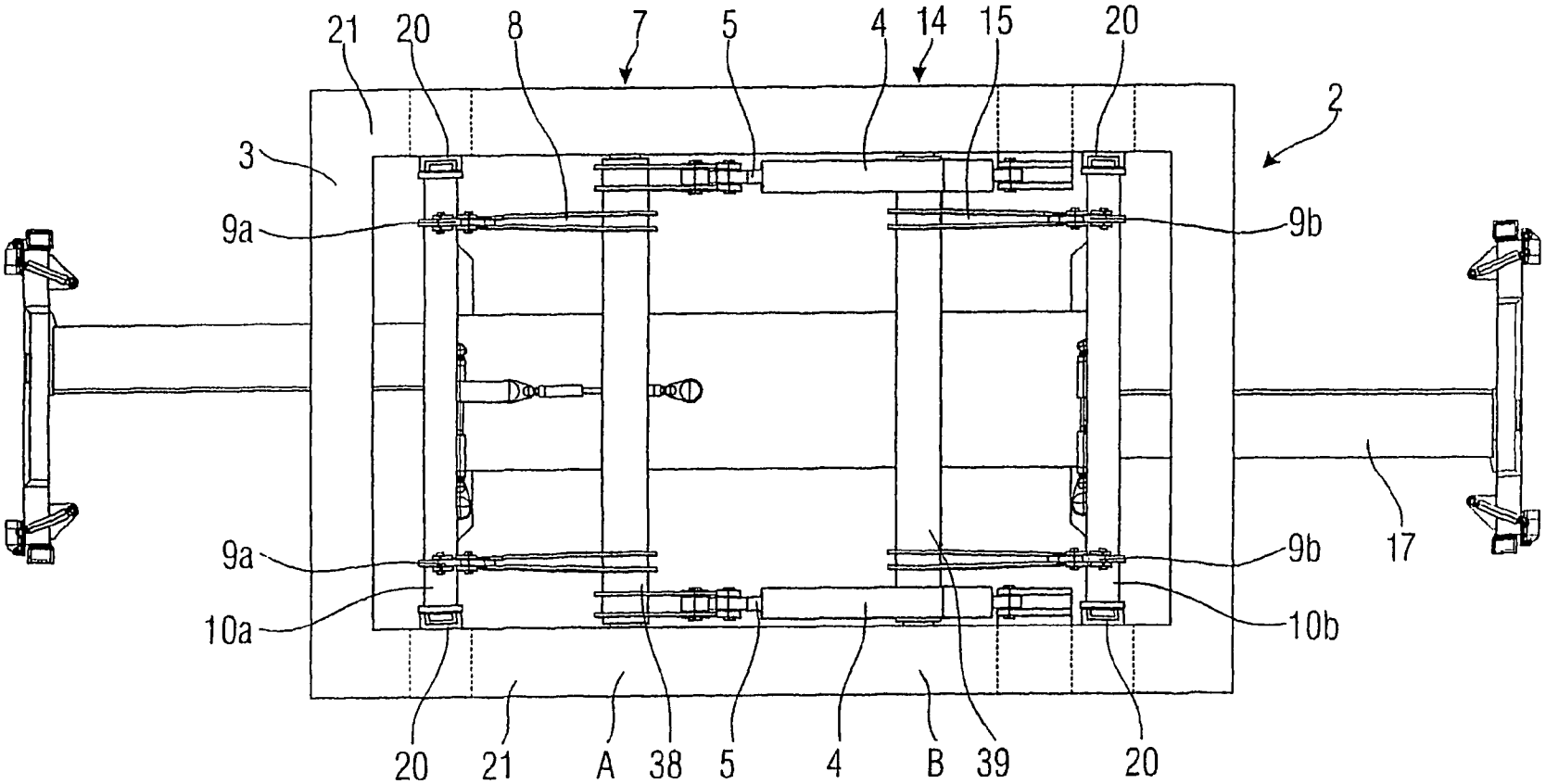
FIG. 4 is a top plan view of the lifting device for a container handling unit in FIG. 3

FIG. 2 shows the container handling unit 1 in a front view, where a container 18 standing on the floor is located in its loading/unloading position. The lifting device 2, the guiding cross-bars 10*a*, 10*b*, and the spreader 17 are likewise in their loading/unloading position, in order to pick up (or unload) the container 18. Arranged on either side of the middle of the cross-bars are a chain, a tie bracket 11*a*, a coupling rod 9*a* and a lever arm 8 of an angle lever 7. The guiding cross-bar 10*a*, thanks to the simultaneous activation of the identical and rigidly connected angle lever 7, runs parallel to the standing surface of the container handling unit 1. One notices from the front view that the embodiment is implemented pairwise (FIG. 4).

Figure 3:
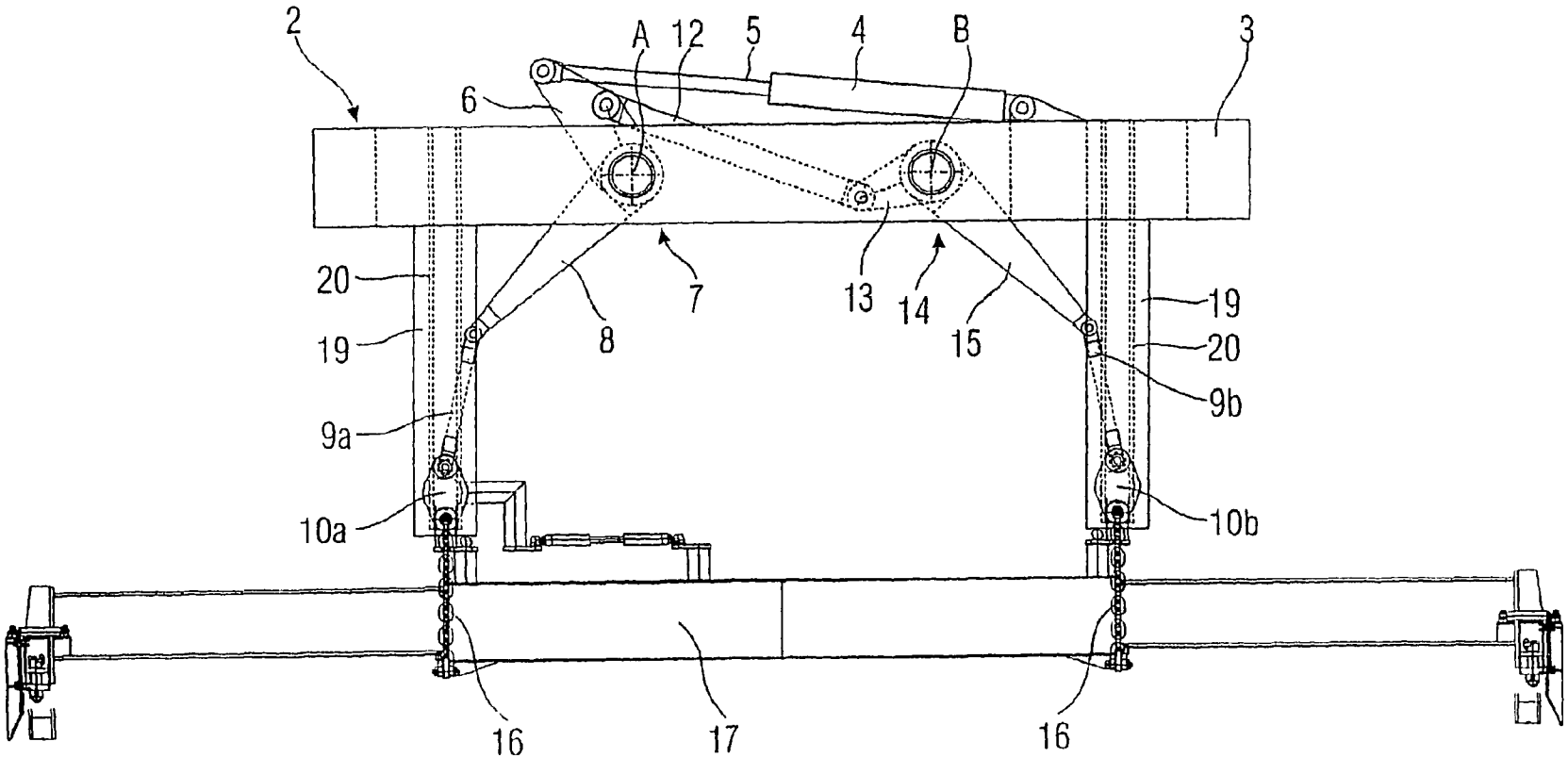
FIG. 3 is a side elevation of the lifting device for a container handling unit in a loading/unloading position.

FIG. 3 shows the lifting device 2 with the angle levers 7 and 14 in side view, again in the loading/unloading position. The piston rod 5 of the hydraulic cylinder 4 is almost fully extended. The angle lever 7 is rotated counterclockwise about its pivot axis A relative to its transport position. As a result, the lever arm 8 and the coupling rod 9*a* are tilted toward the floor, so that the guiding cross-bar 10*a* is in the loading/unloading position. The horizontal coupling rod 12, linked to the lever arm 6 of the angle lever 7, causes the angle lever 14 to turn clockwise about its pivot axis B relative to its transport position. As a result, the lever arm 15 and the coupling rod 9*b* are tilted toward the floor, similar to the lever arm 8 and the coupling rod 9*a*. Accordingly, the second guiding cross-bar 10*b* is likewise in the lower position, at the same height as the first guiding cross-bar 10*a*. The spreader 17, fastened to the guiding cross-bars 10*a* and 10*b* by means of traction means 16 of equal length, is located in its loading/unloading position, parallel to the standing surface of the container handling unit 1.

The lowering and lifting of the spreader 17 is accomplished by the extending and retracting of the piston rod 5 of the hydraulic cylinder 4. As the piston rod 5 travels, the angle levers 7, 14 turn synchronously, so that both guiding cross-bars 10*a*, 10*b* move synchronously, which entails a vertical movement of the spreader 17, which is always situated in a horizontal plane parallel to the standing surface of the container handling unit 1.

In the loading/unloading position, the lever arms 8, 15 of the angle levers 7, 14 project far down and reach into the free space, which is otherwise filled by a container 18 during its transport.

A U-shaped guide rail 20, arranged on the vertical support pillars 19 of the support frame 3, guides the ends of the vertically movable guiding cross-bars 10*a*, 10*b*.

The maximum stroke length of the piston rod 5 of the hydraulic cylinder 4 need not correspond to the distance between lowermost and uppermost end position of the spreader 17. Since the lever arms 6, 8 (and 13, 15) of the angle lever 7 (and 14) are of different length, it works in the manner of a slewing gear. Because the driven lever arms 8, 15 of the angle levers 7, 14 are longer than the lever arms 6, 13, the spreader stroke is larger than the corresponding stroke motion of the piston rod 5.

FIG. 4 shows a top view of a lifting device 2. The hydraulic cylinders 4 are linked by their end opposite the piston rod 5 to the longitudinal columns 21 of the support frame 3, which thus serves to buttress the hydraulic cylinder 4.

The lifting device 2, which comprises the support frame 3, the hydraulic cylinder 4, the piston rod 5, the lever arms 6, 7, 13, 14 of the angle levers 7, 14, the vertical piston rods 9*a*, 9*b* and the horizontal coupling rod 12, are arranged symmetrically to the line of symmetry S. Instead of this pairwise, symmetrical configuration of the hydraulic drive, a single configuration could also be realized.

In the two longitudinal columns 21 of the support frame 3, turning tubes 38, 39 are mounted, the turning tube 38 being able to turn about the axis A and the turning tube 39 about the axis B. Secured to the turning tube 38 on either side of the line of symmetry S are two identical angle levers 7, which are rigidly joined together by the turning tube 38. Thus, the two angle levers 7 move synchronously. Similarly, two identical angle levers 14 are joined together on the turning tube 39.

The lengthwise movement of the piston rod 5 of the hydraulic cylinder 4 displaces the angle lever 7 in a rotary motion, which is transformed by means of the coupling rod 9*a* into a vertical movement of the guiding cross-bar 10*a*. The rotary motion of the angle lever 7 is transmitted by means of the horizontal coupling rod 12 to the angle lever 14, and the angle lever 14 in turn transforms its rotary motion by means of the coupling rod 9*b* into a vertical movement of the guiding cross-bar 10*b*. This design ensures a synchronous movement of the guiding cross-bars 10*a* and 10*b*, which is transmitted via the traction means 16 to the spreader 17 suspended therefrom. This moves up and down each time parallel to the standing surface of the container handling unit 1.

The two ends of the guiding cross-bars 10*a*, 10*b* are each guided in the U-shaped guide rail 20. This guide substantially reduces the twisting of the suspended spreader 17 relative to the support frame 3 and/or the container 18.

Figure 5:
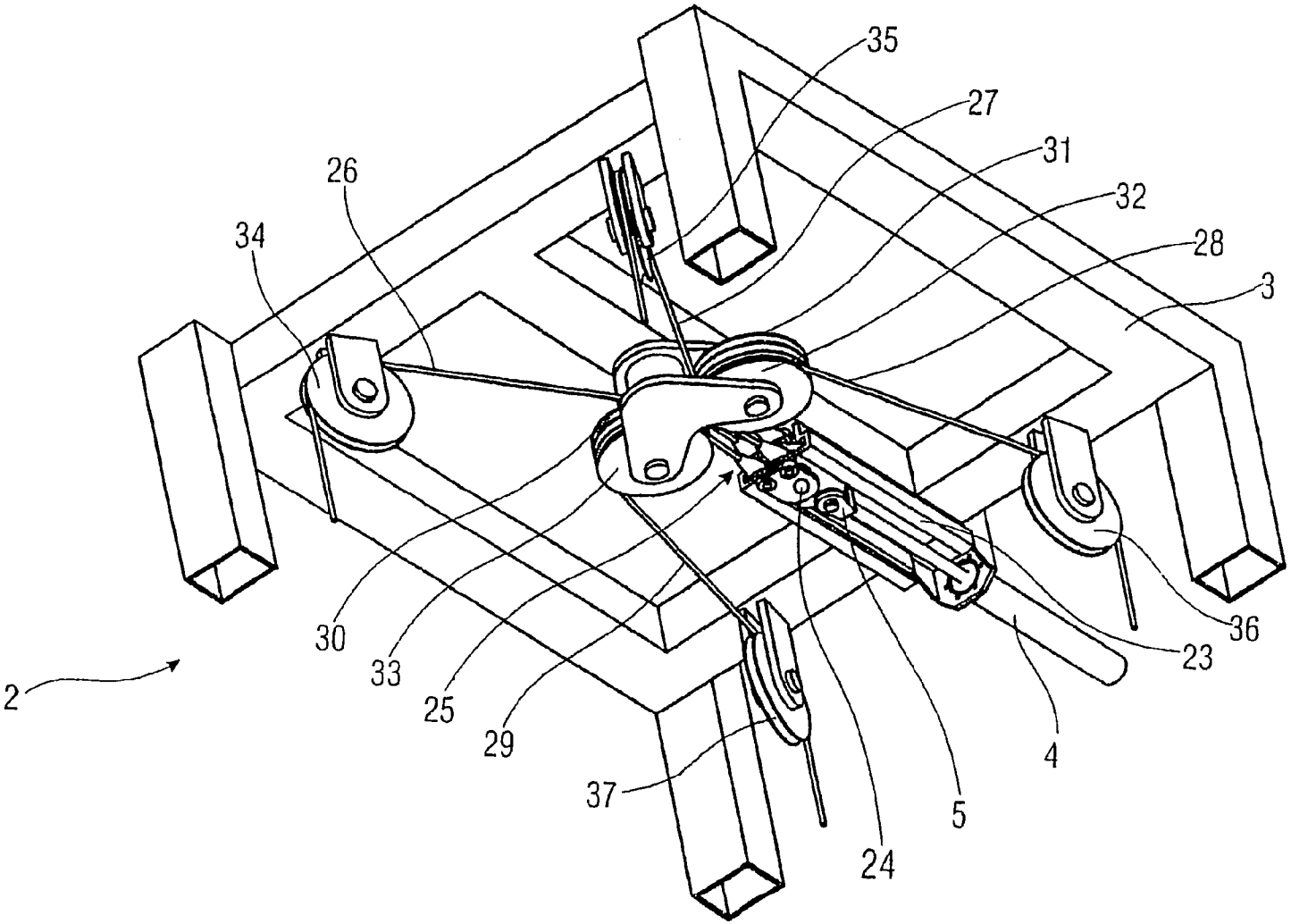
FIG. 5 is a perspective view of a lifting device for a container handling unit using deflected lifting cables.

FIG. 5 shows an alternative configuration of the lifting device 2 in perspective view from below. A hydraulic cylinder 4 firmly connected to the support frame 3 is arranged underneath the support frame 3. The piston rod 5 of the hydraulic cylinder 4 is connected to a sliding piece 24, which can travel in a linear guide 23. At the end of the sliding piece 24 opposite the piston rod 5 are fastened four cable sheaths 25*a*-25*d*, to which four cables 26, 27, 28, 29 are firmly connected. The four cable sheaths 25 are arranged in an imaginary rectangle, so that two cables 26, 27 are located in an upper level and two cables 28, 29 in a lower level. The two pairwise guided cables 26, 27 in the upper level are deflected by two vertically pivoted deflection rollers 30, 31, each going to one of the two corners of the forward support frame 3, from which they are deflected by means of another two horizontally pivoted deflection rollers 34, 35 into the vertical direction. It is not shown that the cables 26, 27 are fastened to the upper ends of the tie bracket 11*a* and terminate there. Similar to the cables 26, 27 of the upper level, the cables 28, 29 of the lower level are deflected pairwise by means of two deflection rollers 32, 33, mounted on vertical pivot axes, so that they each run in the direction of one of the two corners of the rear support frame 3. Here, the cables 28, 29 are deflected by means of two deflection rollers 36, 37 with horizontal pivot axes into the horizontal direction. It is also not shown that the cables 28, 29 are fastened to the upper ends of the tie bracket 11*b* and terminate there.

In this embodiment, there is no reeving of the cable 26-29, in order to preserve a compact design. The maximum stroke height of around 0.80 m, preferably 0.50 m, achieved in this way is sufficient for a plurality of transport applications.

Similar to the embodiment described in FIG. 14, the guiding cross-bar 10*a* is arranged on the tie bracket 11*a* and the guiding cross-bar 10*b* on the tie bracket 11*b*. The spreader 17 is likewise fastened by means of the traction means 16 to the guiding cross-bars 10*a*, 10*b*.

The lengthwise movement of the piston rod 5 of the hydraulic cylinder 4 is transformed by the deflected cables 26-29 into an up and down movement of the guiding cross-bars 10*a* and 10*b* and, thus, that of the attached spreader 17.

The maximum stroke of the piston rod 5 corresponds to the distance between uppermost and lowermost end position of the spreader 17.

Figure 6:
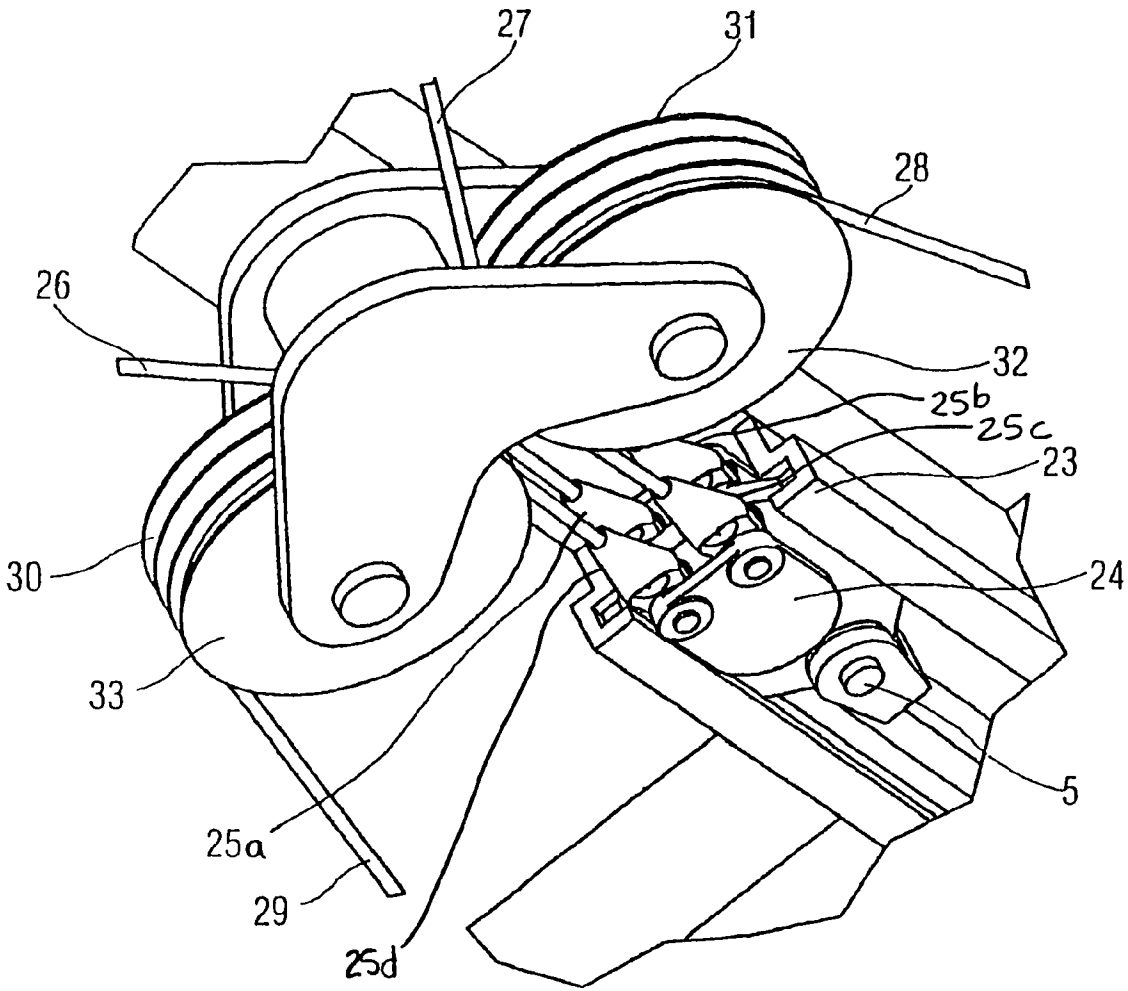
FIG. 6 is a detailed drawing of the lifting device with lifting cables in FIG. 5.

FIG. 6 shows a detailed view of the four deflection rollers 30-33 arranged in an upper and lower level around horizontal pivot axes, including the four cables 26-29, the cable sheaths 15, and the sliding piece 24.

LIST OF REFERENCE NUMBERS

1 Container handling unit
2 Lifting device
3 Support frame
4 Hydraulic cylinder
5 Piston rod
6 Lever arm
7 Angle lever
8 Lever arm
9*a*, 9*b* Vertical coupling rod
10*a*, 10*b* Guiding cross-bar
11*a*, 11*b* Tie bracket
12 Horizontal coupling rod
13 Lever arm
14 Angle lever
15 Lever arm
16 Traction means
17 Spreader
18 Container
19 Support pillar
20 Guide rail
21 Longitudinal beam
22 Flange
23 Linear guide
24 Sliding piece
25*a*, 25*d* Cable sheaths
26-29 Cable
30-33 Vertically mounted deflection roller
34-37 Horizontally mounted deflection roller
38, 39 Turning tube
A Turning axis of angle lever 7
B Turning axis of angle lever 14
S Line of symmetry

The invention claimed is:

1. A lifting device for containers which can be handled by means of container handling equipment, said lifting device comprising:

at least one hydraulic cylinder arranged on a support frame with a piston and a piston rod, at least two horizontal guiding cross-bars spaced apart from each other, wherein lengthwise displacement of said piston rod is transformed into a synchronous upward and downward movement of said horizontal guiding cross-bars, said horizontal guiding cross-bars connected to a load-receiving device for the container, said horizontal guiding cross-bars being guided on vertical support pillars of the support frame at both ends, for the lifting and lowering of the container, wherein transformation of the lengthwise displacement of said piston rod into the upward and downward movement of said horizontal guiding cross-bars is accomplished by at least one angle lever pivoted on said support frame, said at least one angle lever comprising two lever arms, one of said lever arms being connected to said piston rod and the other of said lever arms being connected to one of said guiding cross-bars.

2. The lifting device per claim 1, including a second angle lever, wherein said one of said lever arms connected to said piston rod is linked by a rod-shaped coupling element to a lever arm of said second angle lever, wherein the other lever arm of said second angle lever is connected to the other one of said horizontal guiding cross-bars, wherein extending and retracting said piston rod causes said horizontal guiding cross-bars to move synchronously in the vertical direction.

3. The lifting device per claim 2, wherein each of said guiding cross-bars is connected by a coupling rod to one of said lever arms.

4. The lifting device per claim 3, wherein each of said guiding cross-bars is connected by a coupling rod to one of said lever arms on either side of the middle of the cross-bar.

5. The lifting device per claim 4, including a means for connecting said guiding cross-bars to said load-receiving device, wherein said load-receiving device for the container is suspended in the form of a spreader from said guiding cross-bars.

6. The lifting device per claim 3, including a means for connecting said guiding cross-bars to said load-receiving device, wherein said load-receiving device for the container is suspended in the form of a spreader from said guiding cross-bars.

7. The lifting device per claim 2, wherein each of said guiding cross-bars is connected by a coupling rod to one of said lever arms on either side of the middle of the cross-bar.

8. The lifting device per claim 7, including a means for connecting said guiding cross-bars to said load-receiving device, wherein said load-receiving device for the container is suspended in the form of a spreader from said guiding cross-bars.

9. The lifting device per claim 2, including a means for connecting said guiding cross-bars to said load-receiving device, wherein said load-receiving device for the container is suspended in the form of a spreader from said guiding cross-bars.

10. The lifting device per claim 1, wherein each of said guiding cross-bars is connected by a coupling rod to one of said lever arms.

11. The lifting device per claim 10, wherein each of said guiding cross-bars is connected by a coupling rod to one of said lever arms on either side of the middle of the cross-bar.

12. The lifting device per claim 11, including a means for connecting said guiding cross-bars to said load-receiving device, wherein said load-receiving device for the container is suspended in the form of a spreader from said guiding cross-bars.

13. The lifting device per claim 1, including a means for connecting said guiding cross-bars to said load-receiving device, wherein said load-receiving device for the container is suspended in the form of a spreader from said guiding cross-bars.

14. The lifting device per claim 1, including deflected cables fastened to said piston rod for transforming the lengthwise displacement into the upward and downward motion, said deflected cables being at least indirectly connected at the other end to said guiding cross-bars, wherein freely turning deflection rollers cause the deflection of said deflected cables.

15. The lifting device per claim 14, wherein the deflection of said deflected cables occurs in the direction vertical to the respective guiding cross-bar.

* * * * *